US012747740B2

(12) United States Patent
Rhys-Davies et al.

(10) Patent No.: US 12,747,740 B2
(45) Date of Patent: Sep. 29, 2026

(54) STATOR ASSEMBLY FOR ELECTRIC SUBMERSIBLE PUMP

(71) Applicant: Extract Companies, LLC, Tulsa, OK (US)

(72) Inventors: James Rhys-Davies, Tulsa, OK (US); Mitchell Crane, Tulsa, OK (US); Jason Myska, Tulsa, OK (US)

(73) Assignee: National Oilwell Varco, L.P., Houston, TX (US)

( * ) Notice: Subject to any disclaimer, the term of this patent is extended or adjusted under 35 U.S.C. 154(b) by 0 days.

(21) Appl. No.: 18/226,660

(22) Filed: Jul. 26, 2023

(65) Prior Publication Data

US 2024/0035489 A1 Feb. 1, 2024

Related U.S. Application Data

(60) Provisional application No. 63/392,596, filed on Jul. 27, 2022.

(51) Int. Cl.
*F04D 29/60* (2006.01)
*F04D 13/10* (2006.01)
*F04D 29/40* (2006.01)

(52) U.S. Cl.
CPC ..... *F04D 29/601* (2013.01); *F04D 13/10* (2013.01); *F04D 29/403* (2013.01)

(58) Field of Classification Search
CPC ..... F04D 29/601; F04D 13/10; F04D 29/403; F04D 1/06; F04D 29/0413; F04D 1/063; F04D 29/628; F04D 29/445; F04D 13/086; F04D 29/426; F04D 13/08; F04D 29/0473; F04D 29/086; F04D 29/167; F04D 29/448; F04D 29/046; F04D 29/20; F04D 29/22; F04D 1/08; F04D 29/047; F04D 29/548; F04D 29/708; F04D 7/04; F04D 29/041; F04D 29/0416; F04D 29/2266; F04D 29/44; F04D 29/54; F04D 29/62; F04D 13/021; F04D 17/12; F04D 25/0686; F04D 29/04; F04D 29/043; F04D 29/0476; F04D 29/2222; F04D 29/2272; F04D 29/648; F04D 3/00; F04D 7/045; F04D 9/002; F04D 1/00; F04D 1/066; F04D 1/10; F04D 13/0693; F04D 13/083; F04D 15/0027;

(Continued)

(56) References Cited

U.S. PATENT DOCUMENTS 2,001,172 A * 5/1935 Wintroath ..... F04D 13/10 310/87
2,236,953 A * 4/1941 Schott ..... H04Q 3/42 415/106

(Continued)

FOREIGN PATENT DOCUMENTS

CA 3091148 A1 11/2019
WO 2018/148423 A1 8/2018

OTHER PUBLICATIONS

International Search Report and Written Opinion dated Oct. 20, 2023 received in PCT/US2023/28711.

*Primary Examiner* — Mark A Laurenzi
*Assistant Examiner* — Benjamin Doyle
(74) *Attorney, Agent, or Firm* — Conley Rose, P.C.

(57) ABSTRACT

A stator assembly for an ESP. The assembly can include stators with tabs and corresponding slots that prevent rotation of the stators during use in downhole activities.

16 Claims, 2 Drawing Sheets

(58) Field of Classification Search

CPC ..... F04D 15/0066; F04D 15/0088; F04D 29/026; F04D 29/042; F04D 29/044; F04D 29/0462; F04D 29/0465; F04D 29/0467; F04D 29/083; F04D 29/18; F04D 29/2205; F04D 29/2233; F04D 29/2238; F04D 29/2261; F04D 29/2277; F04D 29/2288; F04D 29/2294; F04D 29/245; F04D 29/284; F04D 29/4206; F04D 29/4273; F04D 29/4293; F04D 29/441; F04D 29/444; F04D 29/605; F04D 29/622; F04D 29/669; F04D 7/02; F16C 2360/44; F16C 35/02; F16C 2226/76; F16C 17/02; F16C 17/107; F16C 17/26; F16C 2204/60; F16C 2206/40; F16C 2206/56; F16C 2206/80; F16C 2206/82; F16C 2226/12; F16C 2226/16; F16C 2240/46; F16C 2240/70; F16C 2300/34; F16C 2300/42; F16C 33/043; F16C 33/08; F16C 35/10; F16C 17/14; F16C 2380/27; F16C 3/02; F16B 21/16; F16B 2200/71; F16B 7/18

USPC ..... 403/364

See application file for complete search history.

(56) References Cited

U.S. PATENT DOCUMENTS 3,265,001 A * 8/1966 Deters ..... F04D 29/2222 416/186 A
3,477,384 A 11/1969 Hlinka
3,600,735 A * 8/1971 Jerabek ..... F16D 1/10 403/348
3,671,786 A * 6/1972 Jones ..... F04D 13/083 310/87
4,063,846 A * 12/1977 Eagle ..... F04D 29/2266 416/186 A
4,227,104 A * 10/1980 Hamman ..... H02K 7/1166 310/90
4,329,122 A * 5/1982 Owada ..... F04D 13/10 310/90
4,483,660 A * 11/1984 Roberts ..... F04D 29/20 416/213 A
4,578,608 A 3/1986 Mech et al.
4,610,465 A * 9/1986 Boyadjieff ..... E02D 5/523 285/308
4,678,399 A * 7/1987 Vandevier ..... F04D 29/167 415/199.2
4,781,531 A * 11/1988 James ..... F04D 29/026 415/196
4,838,758 A * 6/1989 Sheth ..... F04D 29/0413 415/199.2
5,722,812 A * 3/1998 Knox ..... F04D 29/0413 415/199.1
6,068,444 A * 5/2000 Sheth ..... F04D 29/445 415/174.3
6,106,224 A * 8/2000 Sheth ..... F04D 29/0465 415/174.3
6,167,965 B1 * 1/2001 Bearden ..... F04D 15/0088 417/18
6,168,213 B1 * 1/2001 Muller ..... E21B 43/116 285/391
6,315,080 B1 * 11/2001 Doran ..... B66B 11/043 187/250
7,493,960 B2 * 2/2009 Leising ..... E21B 19/22 166/242.6
7,669,671 B2 * 3/2010 Hall ..... E21B 17/046 166/242.6
7,887,098 B2 * 2/2011 Aas ..... E21B 17/043 285/391
8,040,013 B2 * 10/2011 Parmeter ..... E21B 43/128 310/89
8,043,051 B2 10/2011 Brunner
8,267,645 B2 * 9/2012 Brunner ..... F04D 13/10 416/198 A
8,337,142 B2 * 12/2012 Eslinger ..... F04D 29/0413 417/424.2
8,556,580 B2 * 10/2013 Stair ..... F04D 13/10 415/199.2
8,721,181 B2 * 5/2014 Semple ..... F04D 29/0473 384/275
8,894,350 B2 * 11/2014 Brunner ..... F04D 29/041 415/107
9,039,356 B1 * 5/2015 Nowitzki ..... F04D 1/06 415/169.1
9,677,560 B1 * 6/2017 Davis ..... F04D 29/605
10,260,518 B2 * 4/2019 Zheng ..... F04D 13/086
10,267,692 B2 * 4/2019 Son ..... G01L 3/101
10,359,045 B2 * 7/2019 Webster ..... F16C 17/26
10,400,765 B2 * 9/2019 Blankemeier ..... F04C 15/0069
10,890,189 B2 * 1/2021 Eslinger ..... F04D 29/445
10,962,160 B2 * 3/2021 Cooper ..... F16L 23/036
11,085,451 B2 * 8/2021 Lee ..... F04D 29/426
11,174,872 B2 * 11/2021 Hill ..... F04D 29/62
11,293,445 B2 * 4/2022 Sheth ..... E21B 43/128
11,293,455 B2 * 4/2022 Nowitzki ..... F04D 29/548
11,339,789 B2 5/2022 Webster et al.
11,377,939 B1 7/2022 Ye et al.
11,415,144 B2 * 8/2022 Davis ..... F04D 29/046
11,428,230 B2 * 8/2022 Davis ..... F04D 29/086
2002/0079763 A1 * 6/2002 Fleshman ..... H02K 5/132 310/112
2005/0279513 A1 * 12/2005 Eppink ..... E21B 17/10 166/380
2007/0025866 A1 * 2/2007 Douyama ..... F04B 53/22 417/423.3
2008/0111434 A1 5/2008 Head
2008/0292454 A1 * 11/2008 Brunner ..... F04D 1/063 415/199.2
2009/0285678 A1 * 11/2009 Brunner ..... F04D 29/44 415/199.3
2011/0127768 A1 * 6/2011 Elrick ..... F16L 19/0225 285/333
2012/0020777 A1 * 1/2012 Eslinger ..... F04D 1/063 416/174
2012/0027508 A1 * 2/2012 Juh ..... F16D 1/0876 29/428
2014/0167408 A1 * 6/2014 Steen ..... F16L 15/08 285/330
2014/0262524 A1 * 9/2014 Valliyappan ..... F03B 13/02 175/57
2015/0132159 A1 * 5/2015 Wilson ..... E21B 47/017 417/410.1
2015/0159666 A1 * 6/2015 McManus ..... F04D 29/0467 415/199.2
2016/0090992 A1 * 3/2016 Jayaram ..... F04D 29/245 416/185
2016/0115998 A1 * 4/2016 Jayaram ..... F04D 29/448 384/296
2017/0101828 A1 * 4/2017 McGowan ..... E21B 17/043
2017/0102009 A1 * 4/2017 Johnson ..... F04D 13/086
2017/0167498 A1 * 6/2017 Chang ..... F04D 13/10
2017/0211582 A1 * 7/2017 Patel ..... F04D 29/0416
2018/0017066 A1 * 1/2018 Nowitzki ..... F04D 13/086
2018/0195514 A1 * 7/2018 Cheah ..... F04D 29/0413
2018/0291917 A1 * 10/2018 Webster ..... F04D 13/10
2018/0363688 A1 * 12/2018 Westgarth ..... F16B 7/18
2019/0285071 A1 * 9/2019 Webster ..... F04D 13/10
2020/0072030 A1 3/2020 Filatov et al.
2020/0248696 A1 8/2020 Simmons et al.
2020/0340481 A1 * 10/2020 Martinez ..... F04D 29/0473
2021/0048029 A1 * 2/2021 Ye ..... F04D 29/047
2021/0071683 A1 * 3/2021 Nowitzki ..... F04D 29/54
2021/0140436 A1 * 5/2021 Ye ..... F04D 29/043
2021/0320578 A1 10/2021 Sheth et al.

* cited by examiner

STATOR ASSEMBLY FOR ELECTRIC SUBMERSIBLE PUMP

CROSS-REFERENCE TO RELATED APPLICATIONS

The present application claims priority to U.S. provisional application 63/392,596 filed on Jul. 27, 2022 which is incorporated herein by reference. The application is also related to U.S. Pat. No. 11,524,270 which is incorporated herein by reference.

FIELD OF THE DISCLOSURE

The present disclosure relates to an anti-rotation mechanism for use in high-speed electric submersible pumps.

BACKGROUND AND SUMMARY

An electric submersible pump (ESP) is a type of pump used to lift fluids, such as water, oil, or natural gas, from a well to the surface. It is an essential component in many oil and gas production operations. The electric submersible pump is designed to be submerged directly into the wellbore.

The pump is typically comprised of several components including a motor, rotors, and diffusers (or pump stators). The primary function of the diffuser or pump stator is to convert the high-velocity, low-pressure fluid flow exiting the rotors into high-pressure, low-velocity flow. In other words, it slows down the fluid and increases its pressure before it is discharged into the pump's discharge tubing and eventually lifted to the surface. Stator spin causes detrimental pump performance loss during operation. A standard ESP uses compression to increases the resistance to stator spin. However, high speed ESP's that are shorter and have larger differential pressures and torques per stage, require an alternative method to resist stator spin.

These and other deficiencies exist. Therefore, there is need to provide a diffuser assembly to handle the torque applied from the rotor onto the stator.

In some aspects, the techniques described herein relate to an electric submersible pump assembly including: a motor coupled to a pump, wherein the pump includes: a housing; one or more rotors within the housing; and one or more stators on the housing and removably attached to the rotors, wherein the stators include an interior wall, exterior wall, a first open end, and a second open end; wherein the first open end includes a lip and one or more tabs extending from the lip; wherein the second open end includes a recessed lip configured to receive the lip and one or more slots to receive the tabs.

In some aspects, the techniques described herein relate to an electric submersible pump assembly including: a pump including: a housing; a first stator and a second stator on the housing, wherein the stator are removably attached to corresponding rotors, wherein each stator includes an interior wall, exterior wall, a first open end, and a second open end; wherein the first open end includes a lip and one or more tabs extending from the lip; wherein the second open end includes a recessed lip and one or more slots configured to receive the lip and the tabs.

In some aspects, the techniques described herein relate to a stator assembly including: one or more stators removably attached to one or more rotors, wherein the stators include an interior wall, exterior wall, a first open end, and a second open end, wherein the first open end includes a lip and one or more tabs extending from the lip; and wherein the second open end includes a recessed lip configured to receive the lip and the tabs.

Further features of the disclosed systems and methods, and the advantages offered thereby, are explained in greater detail hereinafter with reference to specific example embodiments illustrated in the accompanying drawings.

BRIEF DESCRIPTION OF THE DRAWINGS

In order to facilitate a fuller understanding of the present invention, reference is now made to the attached drawings. The drawings should not be construed as limiting the present invention, but are intended only to illustrate different aspects and embodiments of the invention.

DETAILED DESCRIPTION

Exemplary embodiments of the invention will now be described in order to illustrate various features of the invention. The embodiments described herein are not intended to be limiting as to the scope of the invention, but rather are intended to provide examples of the components, use, and operation of the invention.

Furthermore, the described features, advantages, and characteristics of the embodiments may be combined in any suitable manner. One skilled in the relevant art will recognize that the embodiments may be practiced without one or more of the specific features, advantages, and characteristics of an embodiment. In other instances, additional features, advantages, and characteristics may be recognized in certain embodiments that may not be present in all embodiments. One skilled in the relevant art will recognize that the features, advantages, and characteristics of any embodiment can be interchangeably combined with the features, advantages, and characteristics of any other embodiment.

To address the problem of stator rotation, the present embodiments describe a pump assembly and a stator assembly including stators with tabs and slots. The following embodiments refer generally to an electric submersible pump assembly (ESP) with stators configured to mate with one another via tabs and slots. The ESP can include without limitation: motors, rotors, separators, drivers, cables, pump, housing, shaft, and other conventional elements of an ESP. To reduce stator spin, the stators in the exemplary embodiments can be locked together via tabs and slots, or tabs and tab recesses. The stators can be tube or cylinder shaped. Furthermore, the stators can each have a lip and lip recess (or a tongue and groove configuration) such that the tabs extend from the lip and the slots within the lip recess. The shape, size and quantity of tabs and slot can take on various embodiments with only one being shown below. Although only a limited numbers of stators are shown in the Figures, it is understood that an ESP can use any number of stators and any number of tabs and slots. Furthermore, the material composition of the stators, tabs, and slots can include any suitable material including cast material, metal, or some combination thereof. The stators, tabs, and slots can be made from different materials based on factors like durability, corrosion resistance, and cost-effectiveness. It is understood that the present embodiments do not include certain elements of conventional stators. For example, the embodiments do not include gaskets, O-rings, or ring seals, or any sealing member. Also, the embodiments do not include a coupling ring, a housing adaptor, or any sort of element or member between the interior and exterior of the stator.

Figure 1:
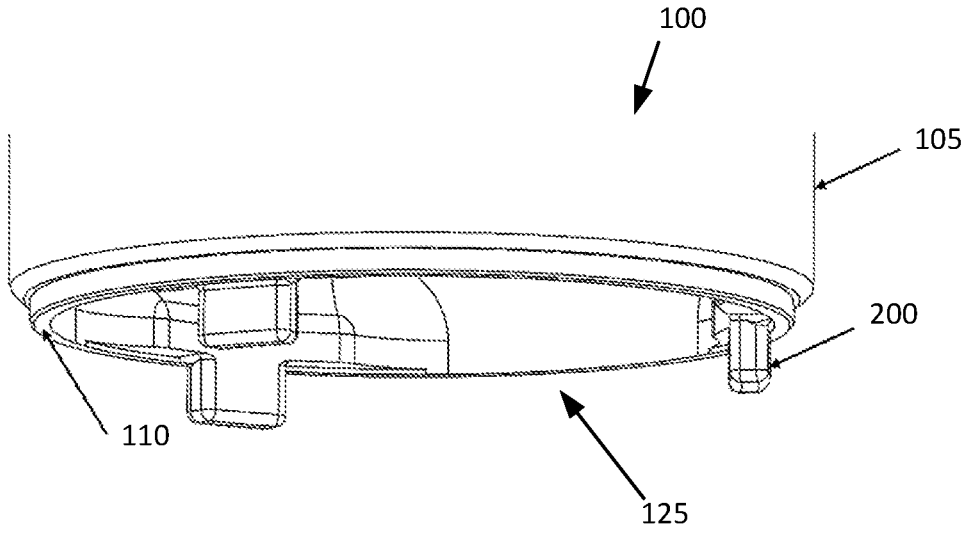
FIG. 1 illustrates a stator with tabs according to an exemplary embodiment.
Figure 2:
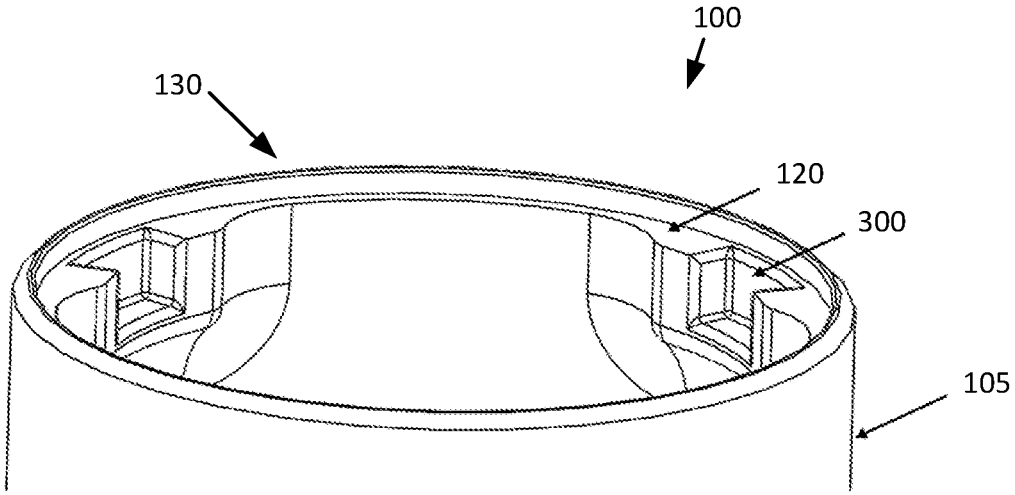
FIG. 2 illustrates a stator with slots for receiving the tabs according to an exemplary embodiment.

FIG. 1 and FIG. 2 illustrate a stator 100 with tabs 200 according to an exemplary embodiment. The stator 100 can be configured to work in connection with an ESP. For example, the stator 100 may housing pump assemblies such as a rotors. The stator 100 can be a cylinder with a first open end 125 and a second open end 130. Protruding from the first open end 125 can be a lip 110, and within the second open end 130 there can be a lip recess 120. With two or more stators, the lip 110 would removably attach to the lip recess of a separate stator. Protruding from the lip 110 can be one or more tabs 200. Though three tabs 200 are pictured, it is understood that more or fewer tabs may be used in other embodiments. The tabs 200 can extend in the same fashion of the lip, that is longitudinally from the stator 100. Within the second open end 130, corresponding slots 300 can extends within the interior of the stator 100 such that the tabs 200 can removably mate with the slots 300.

Figure 3:
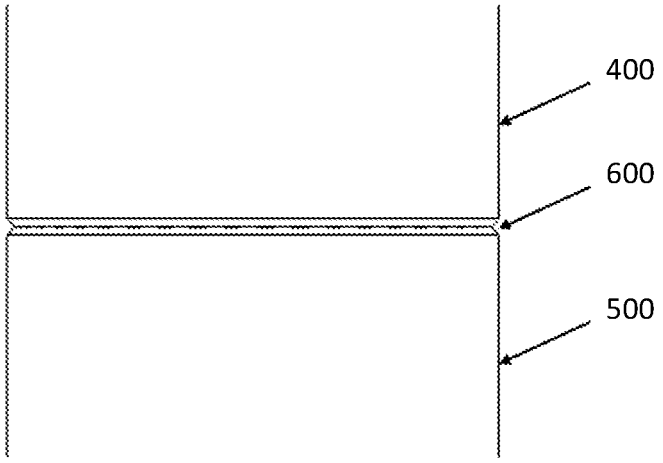
FIG. 3 illustrates a connection of two stators according to an exemplary embodiment.
Figure 4:
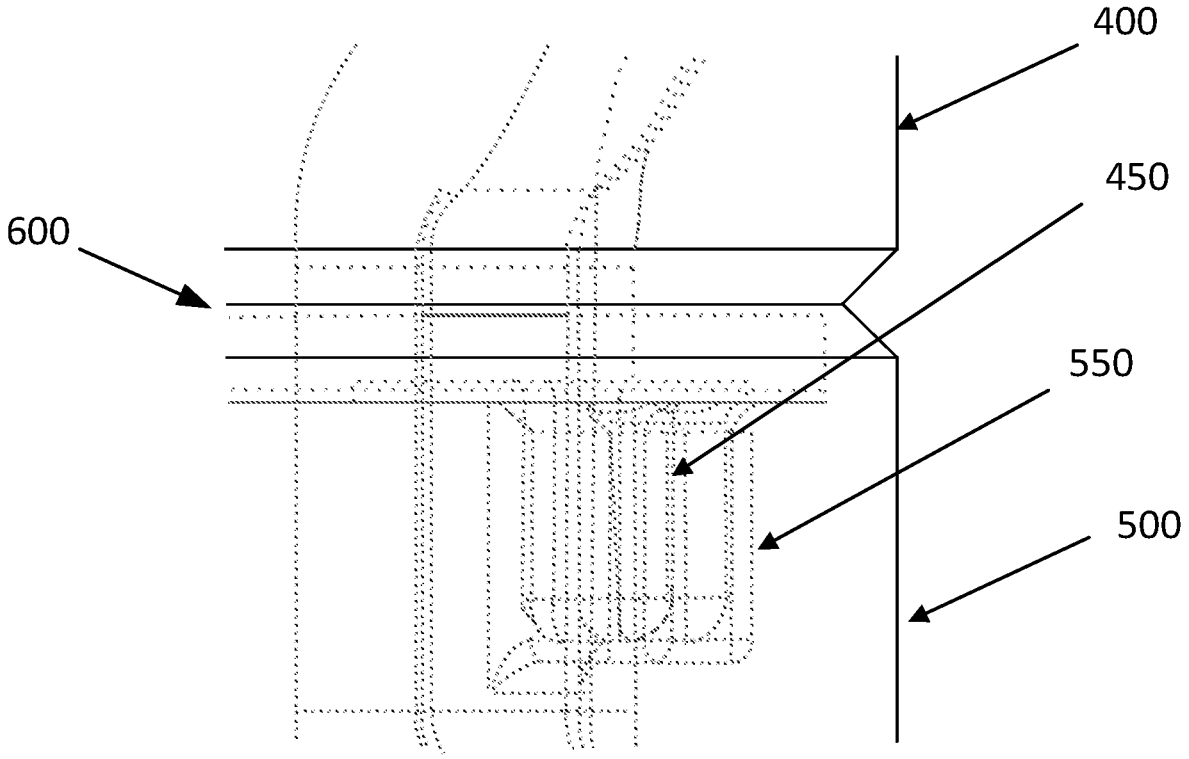
FIG. 4 illustrates a cross-section of two connected stators according to an exemplary embodiment.

FIG. 3 and FIG. 4 illustrate two connected stators. A first stator 400 and a second stator 500 can be connected via the tabs 450 of the first stator 400 and the corresponding slots 550 of the second stator 500 to make a connection point 600. Having been connected, the stators 400 and 500 resists the rotational forces present on the ESP, thus preventing any rotation and consequently pump underperformance. The stators 400 and 500 may be separated from each other after connection.

A unique feature of these tabs and slots is that they are internal to the stator. As shown in FIG. 3 and FIG. 4, when stators are connected, no tabs or slots are exposed. Having these features internally means that there is no leak path from the inside to the outside of the stator, reducing or eliminating the need to have one or more sealing elements (e.g. 0-ring, gasket, sealing member). Instead, a seal is created between the ends of the stators.

Although not pictured, another embodiment of this invention could have slots on both ends of the stators instead of a tab and slot. A pin would be used to align the slots together and resist rotation. In this alternative embodiment, the stators in the electric submersible pump assembly are designed with slots on both ends instead of tabs and slots. The slots on each stator are precisely positioned to align with the corresponding slots on adjacent stators. A pin mechanism is introduced to hold the aligned slots together, providing a secure connection that resists rotational forces during pump operation. These slots are engineered to allow for precise alignment between adjacent stators. During assembly, a specially designed pin made of a durable material, such as stainless steel or tungsten carbide, is inserted through the aligned slots. The pin acts as a connecting rod, firmly holding the stators together and preventing them from rotating independently. For instance, consider an ESP system used in an oil well. The pump assembly consists of three stators with slots on both ends. Each stator is positioned in the housing, and the slots on the first and second ends of adjacent stators are aligned. A pin is then inserted through the aligned slots, connecting all three stators in a rigid formation. This pin mechanism ensures that the stators remain fixed relative to one another and resist rotational forces during pump operation, promoting stable fluid flow and optimal pump performance. In other embodiments, the pin may be used in a tab and slot configuration as described above such that the tab or tabs of a first stator can mate with the slots of the second stator wherein the tabs and slots are configured to receive a pin such that the pin intersects and locks within the tabs and the slots thereby removably attaching the first stator to the second stator.

In some aspects, the techniques described herein relate to an electric submersible pump assembly including: a motor coupled to a pump, wherein the pump includes: a housing; one or more rotors within the housing; and one or more stators on the housing and removably attached to the rotors, wherein the stators include an interior wall, exterior wall, a first open end, and a second open end; wherein the first open end includes a lip and one or more tabs extending from the lip; wherein the second open end includes a recessed lip configured to receive the lip and one or more slots to receive the tabs.

In some aspects, the techniques described herein relate to an assembly, wherein the one or more stators are connected by tongue and groove attachment mechanism including the lips and recessed lips.

In some aspects, the techniques described herein relate to an assembly, wherein the one or more tabs include a tab selected from the group of beveled edges, rounded edges, and sharp edges.

In some aspects, the techniques described herein relate to an assembly, wherein the stators are configured to be nested within one another via the lip and lip recesses, and the tab and the one or more slots.

In some aspects, the techniques described herein relate to an assembly, wherein once the stators are attached, the stators are prevented from rotating relative to one another via the lip and lip recesses and the tab and the one or more slots.

In some aspects, the techniques described herein relate to an assembly, wherein the stators lack a sealing member.

In some aspects, the techniques described herein relate to an assembly, wherein the stators lack a coupling ring.

In some aspects, the techniques described herein relate to an assembly, wherein the stators lack a housing adaptor.

In some aspects, the techniques described herein relate to an assembly, wherein the assembly is configured to be used in a wellbore.

In some aspects, the techniques described herein relate to an electric submersible pump assembly including: a pump including: a housing; a first stator and a second stator on the housing, wherein the stator are removably attached to corresponding rotors, wherein each stator includes an interior wall, exterior wall, a first open end, and a second open end; wherein the first open end includes a lip and one or more tabs extending from the lip; wherein the second open end includes a recessed lip and one or more slots configured to receive the lip and the tabs.

In some aspects, the techniques described herein relate to an assembly, wherein the tabs extend longitudinally from the lip.

In some aspects, the techniques described herein relate to an assembly, wherein the assembly is configured to be used in a wellbore.

In some aspects, the techniques described herein relate to an assembly, wherein the first and second stators once mated are configured to receive a pin that intersects a tab of the first stator and a slot of the second stator.

In some aspects, the techniques described herein relate to an assembly, wherein the tabs and the slots form resist rotational forces on the stators.

In some aspects, the techniques described herein relate to an assembly, wherein each tab includes a tapered design to facilitate insertion into the corresponding slots.

In some aspects, the techniques described herein relate to an assembly, wherein the assembly further includes an alignment feature on the first open end of each stator to assist in aligning the tabs with the corresponding slots.

In some aspects, the techniques described herein relate to an assembly, wherein the tabs are adjustable in length.

In some aspects, the techniques described herein relate to an assembly, wherein the stators are configured to be nested within one another via the lip and lip recesses, and the tab and the one or more slots.

In some aspects, the techniques described herein relate to a stator assembly including: one or more stators removably attached to one or more rotors, wherein the stators include an interior wall, exterior wall, a first open end, and a second open end, wherein the first open end includes a lip and one or more tabs extending from the lip; and wherein the second open end includes a recessed lip configured to receive the lip and the tabs.

Although embodiments of the present invention have been described herein in the context of a particular implementation in a particular environment for a particular purpose, those skilled in the art will recognize that its usefulness is not limited thereto and that the embodiments of the present invention can be beneficially implemented in other related environments for similar purposes. The invention should therefore not be limited by the above described embodiments, method, and examples, but by all embodiments within the scope and spirit of the invention as claimed.

Further, it is to be understood that the terminology used herein is for the purpose of describing particular embodiments only and is not intended to be limiting. The terms "a" or "an" as used herein, are defined as one or more than one. The term "plurality" as used herein, is defined as two or more than two. The term "another" as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time. Also, for purposes of description herein, the terms "upper," "lower," "left," "rear," "right," "front," "vertical," "horizontal," and derivatives thereof relate to the invention as oriented in the figures and is not to be construed as limiting any feature to be a particular orientation, as said orientation may be changed based on the user's perspective of the device.

In the invention, various embodiments have been described with references to the accompanying drawings. It may, however, be evident that various modifications and changes may be made thereto, and additional embodiments may be implemented, without departing from the broader scope of the invention as set forth in the claims that follow. The invention and drawings are accordingly to be regarded in an illustrative rather than restrictive sense.

The invention is not to be limited in terms of the particular embodiments described herein, which are intended as illustrations of various aspects. Many modifications and variations can be made without departing from its spirit and scope. Functionally equivalent systems, processes and apparatuses within the scope of the invention, in addition to those enumerated herein, may be apparent from the representative descriptions herein. Such modifications and variations are intended to fall within the scope of the appended claims. The invention is to be limited only by the terms of the appended claims, along with the full scope of equivalents to which such representative claims are entitled.

The preceding description of exemplary embodiments provides non-limiting representative examples referencing numerals to particularly describe features and teachings of different aspects of the invention. The embodiments described should be recognized as capable of implementation separately, or in combination, with other embodiments from the description of the embodiments. A person of ordinary skill in the art reviewing the description of embodiments should be able to learn and understand the different described aspects of the invention. The description of embodiments should facilitate understanding of the invention to such an extent that other implementations, not specifically covered but within the knowledge of a person of skill in the art having read the description of embodiments, would be understood to be consistent with an application of the invention.

What is claimed is:

1. An electric submersible pump assembly comprising:
a motor coupled to a pump,
wherein the pump comprises:
a housing;
one or more rotors within the housing; and
stators on the housing and removably attached to the rotors,
wherein the stators comprise a longitudinal axis, an interior wall, an exterior wall, a first open end, and a second open end, wherein the first open end includes a first chamfer that tapers radially outward from a lip to the exterior wall and the second open end includes a second chamfer that tapers radially outward from a lip recess to the exterior wall, and wherein the exterior wall is a uniform cylindrical surface between the first chamfer and the second chamfer;
wherein the first open end comprises one or more tabs extending from the lip, wherein the lip comprises an end surface that is completely perpendicular to the longitudinal axis, an interior wall that extends from the lip end surface uniformly parallel to the longitudinal axis, and an exterior wall parallel to the longitudinal axis;
wherein the lip recess is configured to receive the lip and one or more slots to receive the one or more tabs; and
wherein the one or more tabs and the one or more slots to receive the one or more tabs are internal to the stators.

2. The assembly of claim 1, wherein the stators are connected by a tongue and groove attachment mechanism comprising the lips and the lip recesses.

3. The assembly of claim 1, wherein the one or more tabs comprise a tab selected from the group of beveled edges, rounded edges, and sharp edges.

4. The assembly of claim 1, wherein the stators are configured to be nested within one another via the lip and the lip recesses, and the one or more tabs and the one or more slots.

5. The assembly of claim 1, wherein once the stators are attached, the stators are prevented from rotating relative to one another via the lip and the lip recesses and the one or more tabs and the one or more slots.

6. The assembly of claim 1, wherein the stators lack an O-ring, a gasket, or a ring seal.

7. The assembly of claim 1, wherein the assembly is configured to be used in a wellbore.

8. An electric submersible pump assembly comprising:

a pump comprising:

a housing;

a first stator and a second stator on the housing, wherein the stators are removably attached to corresponding rotors, wherein each stator comprises a longitudinal axis, an interior wall, an exterior wall, a first open end, and a second open end, wherein the first open end includes a first chamfer that tapers radially outward from a lip to the exterior wall and the second open end includes a second chamfer that tapers radially outward from a lip recess to the exterior wall, and wherein the exterior wall is a uniform cylindrical surface between the first chamfer and the second chamfer;

wherein the first open end comprises one or more tabs extending from the lip, wherein the lip comprises an end surface that is completely perpendicular to the longitudinal axis, an interior wall that extends from the lip end surface uniformly parallel to the longitudinal axis, and an exterior wall parallel to the longitudinal axis;

wherein the lip recess and one or more slots are configured to receive the lip and the one or more tabs;

wherein the one or more tabs and the one or more slots configured to receive the one or more tabs are internal to the stators.

9. The assembly of claim 8, wherein the tabs extend longitudinally from the lip.

10. The assembly of claim 8, wherein the assembly is configured to be used in a wellbore.

11. The assembly of claim 8, wherein the one or more tabs and the one or more slots resist rotational forces on the stators.

12. The assembly of claim 8, wherein each tab comprises a tapered design to facilitate insertion into the corresponding one of the one or more slots.

13. The assembly of claim 8, wherein the assembly further comprises an alignment feature on the first open end of each stator to assist in aligning the one or more tabs with the corresponding one of the one or more slots.

14. The assembly of claim 8, wherein the one or more tabs are adjustable in length.

15. The assembly of claim 8, wherein the stators are configured to be nested within one another via the lips and the lip recesses, and the one or more tabs and the one or more slots.

16. A stator assembly comprising:

one or more stators removably attached to one or more rotors, wherein the stators comprise a longitudinal axis, an interior wall, an exterior wall, a first open end, and a second open end, wherein the first open end includes a first chamfer that tapers radially outward from a lip to the exterior wall and the second open end includes a second chamfer that tapers radially outward from a lip recess to the exterior wall, and wherein the exterior wall is a uniform cylindrical surface between the first chamfer and the second chamfer, wherein the first open end comprises one or more tabs extending from the lip, wherein the lip comprises an end surface that is completely perpendicular to the longitudinal axis, an interior wall that extends from the lip end surface uniformly parallel to the longitudinal axis, and an exterior wall parallel to the longitudinal axis; and wherein the lip recess is configured to receive the lip and the one or more tabs;

wherein the one or more tabs and the lip recess configured to receive the lip and the one or more tabs are internal to the stators.

* * * * *